US007536821B1

(12) United States Patent
Saur

(10) Patent No.: US 7,536,821 B1
(45) Date of Patent: May 26, 2009

(54) CARTRIDGE CASING CATCHER WITH REDUCED FIREARM EJECTION PORT FLASH AND NOISE

(75) Inventor: Thomas W. Saur, Dearborn, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 479 days.

(21) Appl. No.: 11/527,651

(22) Filed: Sep. 18, 2006

Related U.S. Application Data

(63) Continuation-in-part of application No. 11/345,683, filed on Jan. 30, 2006, now Pat. No. 7,134,233, which is a continuation-in-part of application No. 10/946,248, filed on Sep. 21, 2004, now Pat. No. 7,043,863, which is a continuation-in-part of application No. 10/674,599, filed on Oct. 1, 2003, now Pat. No. 6,836,991.

(51) Int. Cl.

| | |
|---|---|
| ***F41A 15/00*** | (2006.01) |
| ***F41A 9/00*** | (2006.01) |
| ***F01N 1/10*** | (2006.01) |
| *F42B 39/00* | (2006.01) |

(52) U.S. Cl. ..... 42/98; 89/33.4; 206/3; 181/252; 181/256; 181/264

(58) Field of Classification Search ..... 42/98; 89/33.4; 181/252, 256, 264; 206/3, 317
See application file for complete search history.

(56) References Cited

U.S. PATENT DOCUMENTS

| | | | | |
|---|---|---|---|---|
| 663,262 | A * | 12/1900 | Charles | 224/0.5 |
| 4,028,834 | A * | 6/1977 | Dobson | 42/98 |
| 4,334,375 | A * | 6/1982 | Olson | 42/98 |
| 4,715,141 | A * | 12/1987 | Kohnke | 42/98 |
| 5,934,002 | A * | 8/1999 | Blanchet | 42/98 |
| 6,836,991 | B1 * | 1/2005 | Saur | 42/98 |
| 7,043,863 | B2 * | 5/2006 | Saur | 42/98 |
| 7,134,233 | B1 * | 11/2006 | Saur | 42/98 |

* cited by examiner

*Primary Examiner*—J. W Eldred
*Assistant Examiner*—Daniel J Troy
(74) *Attorney, Agent, or Firm*—David L. Kuhn; Luis Miguel Acosta; Thomas W. Saur

(57) ABSTRACT

A catcher, in combination with a firearm having an ejection port, for receiving and retaining expended magnetically attracted shell casings through the ejection port as the firearm is discharged. The catcher includes a hollow housing having a plurality of rigid walls, and retainers. One of the walls has an opening in communication with the ejection port when the catcher is mounted to the firearm for receiving the shell casings. A seal is attached to the housing at the opening and surrounding the opening and provides controlled release of pressurized ejection port gas from inside the housing as the firearm is discharged such that noise and flash as a result of escape of the pressurized ejection port gas is reduced or eliminated.

14 Claims, 8 Drawing Sheets

CARTRIDGE CASING CATCHER WITH REDUCED FIREARM EJECTION PORT FLASH AND NOISE

CROSS-REFERENCE TO RELATED APPLICATIONS

This application is a continuation-in-part of U.S. application Ser. No. 11/345,683, filed Jan. 30, 2006 now U.S. Pat. No. 7,134,233, which is a continuation-in-part of U.S. application Ser. No. 10/946,248, filed Sep. 21, 2004, now issued as U.S. Pat. No. 7,043,863, which is a continuation-in-part of U.S. application Ser. No. 10/674,599, filed Oct. 1, 2003, now issued as U.S. Pat. No. 6,836,991.

GOVERNMENT INTEREST

The invention described here may be made, used and licensed by and for the U.S. Government for governmental purposes without paying royalty to me.

BACKGROUND OF THE INVENTION

1. Field of the Invention

The present invention generally relates to a cartridge casing catcher with reduced firearm ejection port flash and noise.

2. Background Art

Cartridge casing catchers are mounted adjacent the ejection port of a firearm to catch the spent cartridge casings as the casings are ejected after a round is fired. The spent cartridge casings are generally collected for reloading and to prevent casings from being underfoot which can cause a shooter or observer unstable shooting or movement. The spent cartridge casings may also be collected by a cartridge casing catcher (and container) to reduce the evidence left at the shooting site and to reduce the noise generated during the shooting by eliminating the noise generated when the casings impact the surface (i.e., floor, roof, etc.) where the shooter (i.e., firearm user) is positioned. An example of a conventional spent shell container is shown in U.S. Pat. No. 4,166,333 to Kratzer (Kratzer '333).

Conventional spent cartridge casing catchers such as shown in the Kratzer '333 patent can have a deficiency in that spent cartridges are ejected with a significant force and tend to bounce inside the collection chamber and in some instances, the spent cartridge can bounce back into the firearm ejection port causing the firearm to jam. Such a jam is highly undesirable when the firearm user is involved in a critical mission situation. In any event, clearing jammed firearms is typically a time consuming, annoying, and potentially hazardous task.

Conventional spent cartridge casing catchers such as shown in the Kratzer '333 patent also have a deficiency in that such spent cartridge casing catchers are only effective when the firearm is operated in a normal (typical) design position (i.e., with the weapon trigger grip in a substantially vertical position, and the weapon ejection port in a substantially horizontal position). That is, such conventional approaches only catch and hold spent cartridge casings when gravitational forces cause the spent cartridge casings to drop or move to a location in the catcher that is generally away from the firearm ejection port. As such, when the user operates the firearm in an orientation that is not the orientation for which the spent cartridge casing catcher was designed (typically a normal firearm operation position), the spent cartridge casings are typically not properly captured and held and can readily cause the firearm to jam in many orientations of the firearm.

However, the firearm user can not always fire the weapon from a position from which the conventional spent cartridge casing catcher was designed to operate, and firearm jams can result. For example, when the shooter desires to obtain a clear shot at a target, to avoid detection, operate the firearm at an oblique angle to provide clearance for a gas mask, operate the firearm "out of position," fire the weapon "around the clock" (i.e., through a full circle of rotation, including when the weapon is upside down, for instance when firing during a rolling maneuver), etc.

Conventional spent cartridge casing catchers such as shown in the Kratzer '333 patent may have additional deficiencies in that the spent cartridges tend to rattle in the catcher collection chamber and thus cause additional undesirable noise.

The muzzle report of blow back operated and closed breech firearms may be reduced by the installation of a so-called "silencer" (more properly called a suppressor, also referred to as a muffler) on the muzzle, integral with the barrel of the firearm, or both on the muzzle and integral with the barrel. Examples of some conventional firearms suppressors are shown in U.S. Pat. No. 5,033,356 to Richardson, U.S. Pat. No. 1,018,720 to Maxim, and U.S. Pat. No. 1,229,675 to Thompson. However, significant noise and flash (i.e., blast) are generated and expelled at the breech and out of the ejection port of the firearm, especially for open-bolt (or blowback) firearms, and from a closed breech weapon, especially from a so-called gas impingement operating firearm such as AR15 rifles, M4 carbines, and M16 assault rifles to an extent which can be unacceptable for clandestine operations.

For example, well suppressed weapons such as the Heckler & Koch Model HK MP5SD, while having very low muzzle report, still produce noise and flash from the ejection port which presents a blast that may be significant and unacceptable in some situations (e.g., when minimal noise is desired, when minimal visible presence such as flash is desired, and the like). Suppressed gas impingement and gas piston operating firearms such as suppressed M4, AR15, M16 assault rifles, and the like still produce noise and flash from the ejection port also. In such firearms muzzle mounted and integral suppressors typically exacerbate or increase ejection port blast.

Open bolt weapons such as the Ingram MAC-10 and Uzi Submachine Gun, even when equipped with a muzzle mounted or integral noise suppressor, still can produce noise (as well as flash) from the breech that is at a level such that the user advisably wears ear protection to reduce the likelihood of hearing loss. Conventional casing catchers such as shown in the Kratzer '333 patent and especially bag type spent cartridge catchers may provide some flash reduction but provide very little reduction of the noise emitted at the firearm port.

Firearms such as the M16 assault rifle, the M4 carbine, the AR15 rifle, H & K MP5, Uzi, MAC-10, and so forth (i.e., especially but not exclusively firearms that are gas piston, gas impingement, and blowback and delayed blowback operated), when equipped with a snug fitting and well encapsulating cartridge casing catcher (e.g., an apparatus for collecting cartridge casings as shown and described in U.S. Pat. No. 4,334,375 to Olson (Olson '375), or the like), and also equipped with a muzzle mounted suppressor may generate an excessive barrel chamber post-firing gas back pressure when the firearm discharges such that ejection port flash and noise may not be contained within the cartridge casing catcher.

In particular and especially when the firearm is operated in very rapid fire semi-automatic mode or in full-automatic mode, ejection port gas that is fluidly transmitted into the cartridge casing catcher may build up excessive pressure within the cartridge casing catcher such that flash and noise may escape past the interface of the cartridge casing catcher and the firearm receiver (i.e., so-called blow by). The ejection port flash and noise that escapes past the interface and into the surrounding atmosphere may be undesirable in critical situations where absolute minimal audible noise and visible flash are desired by the user (generally a Soldier in a location near hostile forces).

For example, provides a container that is arranged to be quickly attached to or removed from a closed chute that is disposed around the ejection port of a submachine gun so that empty cartridge casings expelled from the gun are deposited into the container in a manner such that gases remaining in the casings cannot escape into the surrounding atmosphere. However, when such an apparatus is implemented in connection with suppressor equipped firearms that are operated as indicated above, the container can become filled with pressurized gases that may be blown by and escape.

Further, the firearm operating mechanism (e.g., bolt and carrier actuation), especially in the case of semi-automatic and full-automatic firearms, generates noise that can compromise the location of the firearm user. Such firearm mechanism generated noise is typically not attenuated to any significant level by conventional spent cartridge casing catchers such as shown in the Kratzer '333 patent, Olson '375, and the like. Such firearm operating mechanism noise is typically not reduced by conventional muzzle mounted firearms suppressors.

Thus, there exists a need and an opportunity for a spent cartridge casing catcher having reduced firearm ejection port flash and noise. Such an improved cartridge casing catcher may overcome deficiencies of conventional approaches.

SUMMARY OF THE INVENTION

Accordingly, the present invention may provide a cartridge casing catcher with reduced firearm ejection port flash and noise that comprises an improved spent cartridge casing catcher including acoustic tuning, and a housing-to-firearm receiver interface having controlled release of pressure. Such an improved spent cartridge casing catcher may provide reduced or eliminated bouncing of the spent cartridges back into the firearm ejection port and so reduce or eliminate jamming caused by the spent cartridge casings bouncing back, reduced or eliminated rattle of collected spent cartridge casings, and reduced or eliminated firearm ejection port blast flash and noise and firearm mechanism noise when compared to conventional approaches. Such an improved spent cartridge casing catcher may overcome other deficiencies of conventional approaches and provide further advantages when compared to conventional approaches.

According to the present invention, a cartridge casing catcher, in combination with a firearm having an ejection port, for receiving and retaining expended magnetically attracted shell casings through the ejection port as the firearm is discharged is provided. The catcher comprises a hollow housing having a plurality of rigid walls, a seal, and retainers. One of the walls has an opening in communication with the ejection port when the catcher is mounted to the firearm for receiving the shell casings.

At least one of the other walls comprises a plurality of deflectors and each of the deflectors has a front face that is slanted away from the opening such that the deflectors are capable of deflecting the shell casings away from the opening and a rear face that is perpendicular to the planar surface of the housing or slanted away from the opening, and at least one of the deflectors, alone or in combination with one or more other of the deflectors and a respective wall, comprise a void and an aperture configured as an acoustic tuner structure tuned to provide reduction of noise emitted at the ejection port.

The seal may be attached to the housing at the opening and surrounding the opening, wherein the seal comprises a resilient, compliant material in a solid, gel-sac, closed-cell foam, or skin covered foam configuration having a surface that interfaces to the firearm and the surface includes at least three resilient, compliant sealing lips that provide controlled release of pressurized ejection port gas from inside the housing as the firearm is discharged such that noise and flash as a result of escape of the pressurized ejection port gas is reduced or eliminated.

The retainers may be mounted at the rear face of the deflectors and are generally capable of retaining the shell casings when the catcher is in any position. The retainers comprise a permanent magnetic material.

The retainers may have a maximum magnetic energy product value that is sufficient to capture and retain the expended shell casings.

The acoustic tuner structure comprises at least one of a quarter wave tuner, a Quincke tuner, and a Helmholtz tuner.

The magnetic material comprises magnetic strips that may be affixed to the rear face of respective deflectors.

Each of the deflectors generally has a height that is equal to or greater than the diameter of the shell casings that are captured by the catcher.

The deflectors may be adjacent or may be separated by a gap.

The magnetic material may further comprise magnetic strips that are affixed to the gaps when the deflectors are separated by the gap.

The magnetic material may be embedded into the rear face of respective deflectors.

The magnetic material is generally at least one of steel, Strontium and Barium ferrite, Samarium-Cobalt, Neodymium-Iron-Boron, and Aluminum-Nickel-Cobalt alloy.

The sealing lips may be formed on the surface that interfaces to the firearm in a substantially triangular shape having one side of the triangular shape integral with the surface.

The sealing lips are generally spaced apart such that the distance between adjacent sealing lips is greater than the height of the triangular shape.

The apex of the triangular shaped sealing lips may be biased outwardly from the opening.

The sealing lips may be formed on the surface that interfaces to the firearm in a substantially half-round shape having the flat base of the half-round shape integral with the surface.

The sealing lips are generally spaced apart such that the distance between adjacent sealing lips is greater than the height of the half-round shape.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Figure 1:
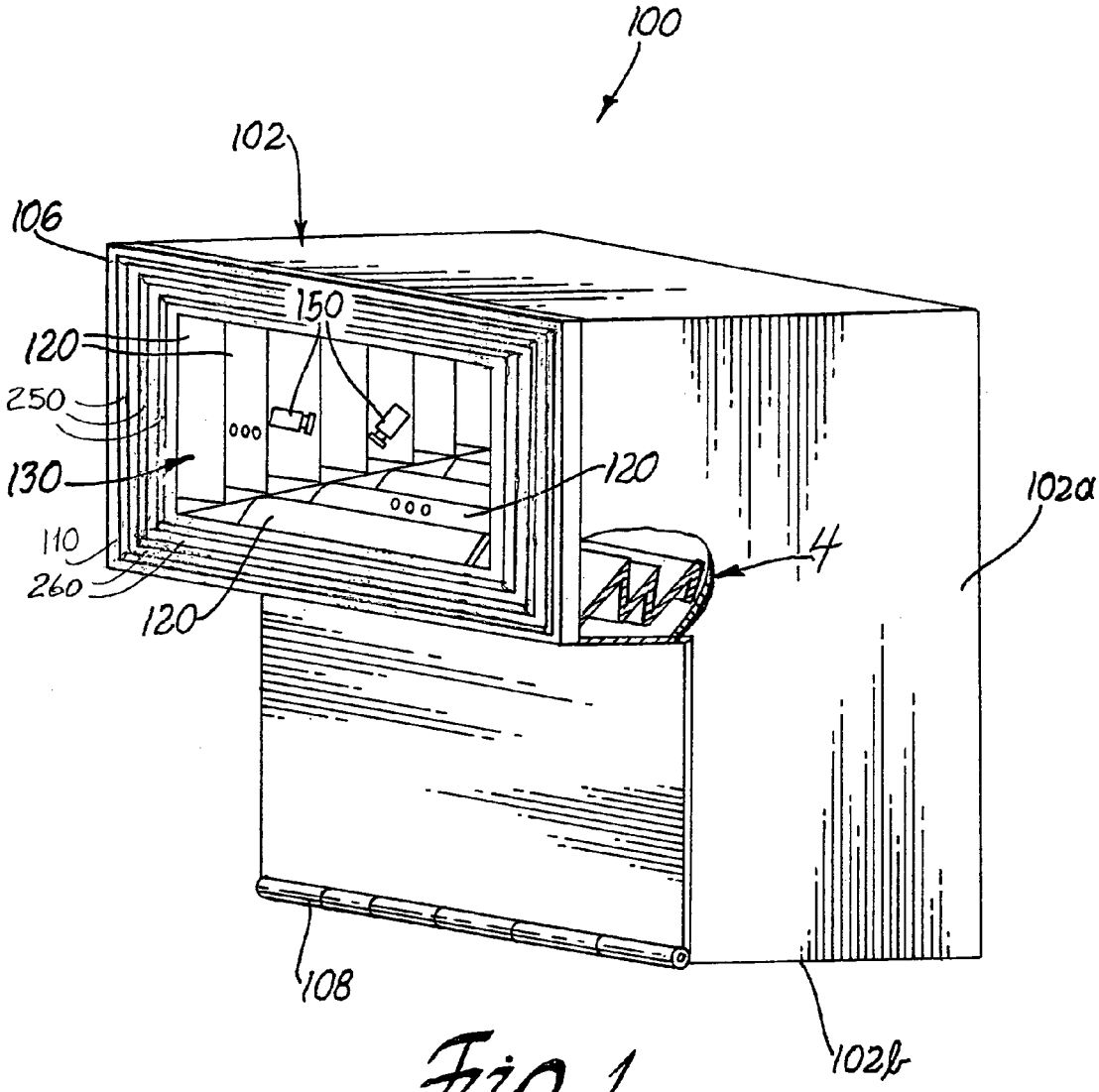
FIG. 1 is a diagram of a perspective view a spent cartridge casing catcher of the present invention.

The present invention generally provides an improved cartridge casing catcher. A user of a firearm (i.e., a shooter) may desire to catch the spent cartridge casings as the casings are ejected from the firearm after a round is fired. The spent cartridge casings (i.e., shell casings) may be collected (e.g., using a cartridge casing catcher (and container)) to prevent the casings from being underfoot which can cause the shooter or an observer unstable shooting or movement. The spent cartridge casings may also be collected by a cartridge casing catcher to reduce the evidence left at the shooting site and to reduce the noise generated during the shooting by eliminating the noise generated when the shell casings impact the surface (i.e., floor, roof, etc.) where the shooter is positioned.

Further, the shooter may wish to reduce or eliminate noise generated by rattle of collected spent cartridge casings in the cartridge casing catcher.

Yet, further, the shooter may wish to operate the firearm in a position other than the normal operating position (i.e., other than with the weapon trigger and grip, and sight alignment in a substantially vertical position) such that the shooter can obtain a clear shot at a target, can operate the firearm while wearing a gas mask, to avoid detection, etc. by operating the firearm "out of position." Yet further, the shooter may desire to have a cartridge casing catcher that operates properly when the firearm is fired "around the clock" (i.e., in a normal position and through a full circle of rotation generally along any axis of rotation, including when the weapon is upside down, for instance when the shooter is firing the weapon as well as performing a rolling maneuver on a surface, flipping or twisting in mid-air, and the like).

The user may wish that the noise and flash that are emitted from the ejection port when the firearm is discharged are reduced or eliminated to reduce or eliminate the likelihood of detection.

The user may wish to reduce or eliminate the noise generated by the firearm operating mechanism, especially in the case of semi-automatic and full-automatic firearms. Such firearm mechanism generated noise is typically not attenuated by conventional firearms accessories of any kind.

While a number of cartridge casings are produced from non-magnetically attractive materials such as brass and aluminum, cartridge casings are also commonly made of mild steel. The cartridge casings that are made of mild steel are generally attracted (i.e., pulled towards and held) by a magnet. As such, a magnetic material (e.g., a permanent magnet) with sufficient magnetic force will generally be capable of attracting and holding cartridge casings that are particularly made of mild steel (i.e., steel casings), and cartridge casings that are generally made from any ferromagnetic (or other magnetically attracted) material. The present invention may be advantageously implemented in connection with cartridge casings that are generally made from such magnetically attracted material.

With reference to the Figures, the preferred embodiments of the present invention will now be described in detail. Generally, the present invention provides an improved spent cartridge casing catcher having acoustical tuning for noise reduction and reduced or eliminated ejection port noise and flash. The spent cartridge casing catcher implemented in connection with the present invention is generally used in combination with a firearm. The spent cartridge casing catcher implemented in connection with the present invention is generally mounted (i.e., fastened, fixed, attached, etc.) adjacent to and covering (i.e., over, in communication with, etc.) an ejection port of a semi-automatic or full-automatic firearm.

In one example, the cartridge casing catcher implemented in connection with the present invention may be advantageously mounted to the firearm via an apparatus similar to the mounting shown in U.S. Pat. No. 4,166,333 to Kratzer (hereinafter Kratzer '333), which is incorporated herein by reference in its entirety, on FIG. 4 of Kratzer '333. In other examples, the spent cartridge casings catcher of the present invention may be mounted to a firearm via clamping apparatuses similar to the mountings shown in U.S. Pat. No. 4,334,375 to Olson, U.S. Pat. No. 4,430,820 to Marsh, and U.S. Pat. No. 5,651,208 to Benson, which are also incorporated herein by reference in their entirety, on FIGS. 2 and 3 of Olson '375, FIGS. 1 and 3 of Marsh '820, and FIG. 7 of Benson '208, respectively. One example of a mounting bracket is shown below in connection with FIG. 9. However, the cartridge casing catcher implemented in connection with the present invention may be mounted to the firearm where implemented via any appropriate apparatus as is well known in the art to meet the design criteria of a particular application.

The present invention is a continuation-in-part of U.S. application Ser. No. 11/345,683, filed Jan. 30, 2006, which is a continuation-in-part of U.S. application Ser. No. 10/946,248, filed Sep. 21, 2004, now issued as U.S. Pat. No. 7,043,863, which is a continuation-in-part of U.S. application Ser. No. 10/674,599, filed Oct. 1, 2003, now issued as U.S. Pat. No. 6,836,991. U.S. Pat. Nos. 6,836,991 and 7,043,863 are incorporated herein by reference in their entirety. As such, an understanding of all of the teachings of U.S. Pat. Nos. 6,836,991 (the '991 patent) and 7,043,863 (the '863 patent) is assumed herein.

Referring to FIG. 1 of the present invention, a diagram illustrating a system (i.e., apparatus, assembly, catcher, receptacle, etc.) 100 in accordance with the present invention is shown. A cut-out sectional view at line 4 is described below in connection with FIGS. 4(A-C). The apparatus 100 generally comprises an acoustically tuned multi-position spent cartridge casing catcher. In one example, the catcher 100 generally comprises a generally hollow housing (i.e., case, box, container, etc.) 102, and a lip area seal (e.g., gasket, and the like) 106. In one example, the housing 102 may be implemented having walls configured as a box-on-box structure or shape (i.e., an upper box and a lower box) as illustrated. However the housing 102 may be implemented having any appropriate shape to meet the design criteria of a particular application.

The apparatus 100 is generally implemented (i.e., used) in combination (i.e., in connection) with a firearm (e.g., firearm 300, shown and described in connection with FIGS. 9-11). The upper box is generally attached to a firearm (such as the fire arm 300) via an attachment mechanism (not shown) such that an opening 130 into the housing 102 mechanically and fluidly communicates with an ejection port of the firearm (e.g., ejection port 310, shown and described in connection with FIGS. 10 and 11) and receives spent (or expended) cartridges (i.e., empty shells, casings, etc.) as the shells are ejected from the firearm, and the blast (i.e., flash and noise) that is emitted from the ejection port when the firearm is discharged (i.e., when the firearm is fired). The lower box may comprise fixed walls 102*a*, a lid 102*b* having a hinge 108, and an opposing latch (not shown) that may provide for access to the interior of the shell catcher 100, for example, for emptying spent cartridges from the catcher 100.

The housing 102 may be implemented having a structure similar to the spent firearm cartridge catcher taught by the '991 patent and the '863 patent. The housing 102 of the present invention is generally implemented without the acoustic foam disclosed in the '991 patent and the '863 patent. Further, the case 102 may be implemented having walls of any appropriate general outside shape and configuration to meet the design criteria of a particular application. The housing 102 is generally produced (i.e., manufactured, built, made, implemented, etc.) using a substantially rigid material. Example materials for implementation of the case 102 may include steel, aluminum, rigid plastic, fiber-reinforced plastic, loaded (e.g., filled with a dense material such as lead, clay, or the like) plastic, and the like. Such materials may provide a high level of acoustic transmission loss.

Figure 6:
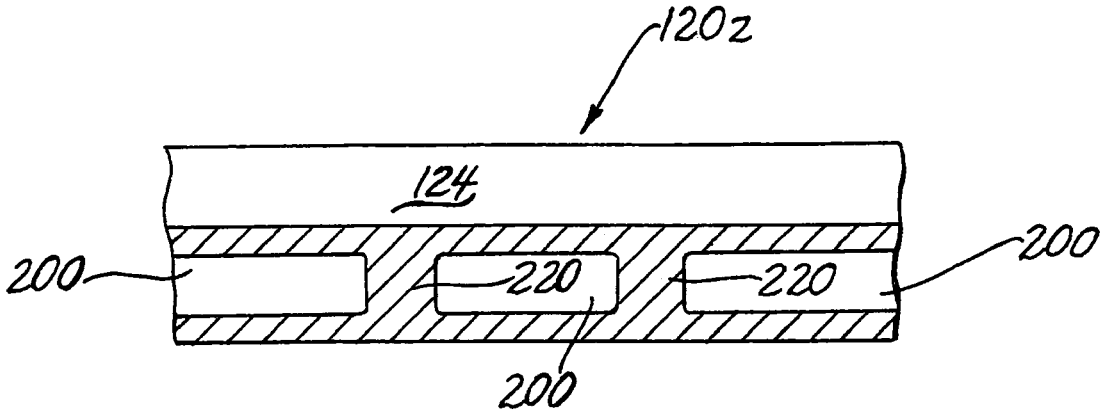
FIG. 6 is a diagram of a sectional view of a support structure of the present invention.

Further referring in particular to the '863 patent, on FIG. 6 and in the corresponding description at col. 7, l. 60-col. 8, l. 5, the substantially rigid wall 102 is shown having a convoluted shape that forms the wedges 120 that include the retainers 124 fixed thereon. In particular, a hollow in the wall 102 is shown in connection with the deflector 120*y'*.

Figure 7:
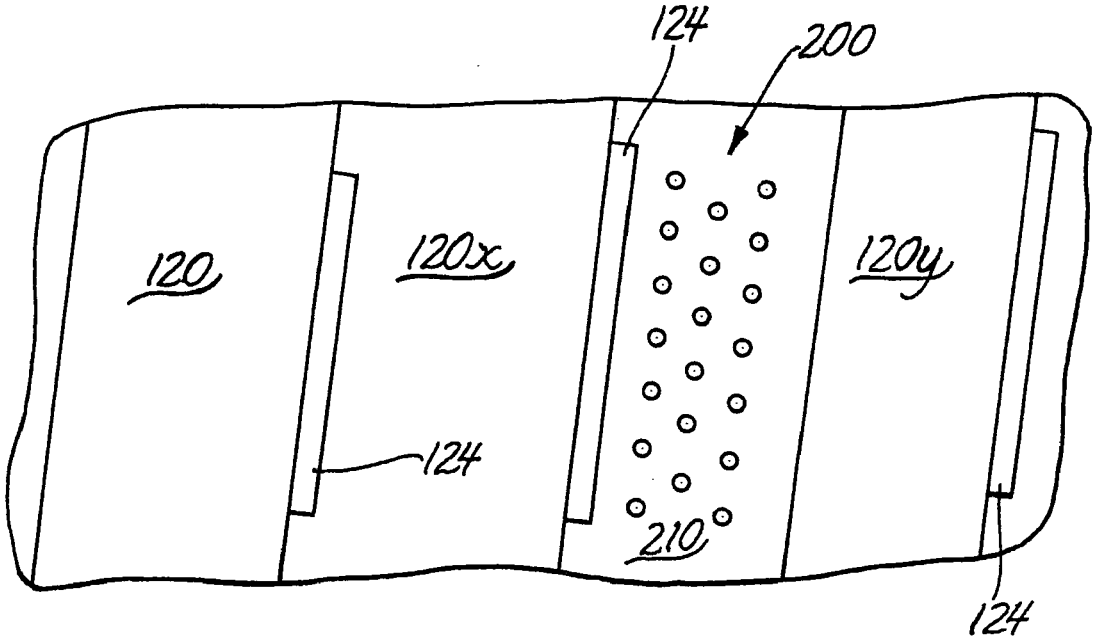
FIG. 7 is a diagram of a top view of portion of deflectors illustrating one example hole placement of the present invention.

Yet further referring to the '863 patent, on FIG. 7 and at col. 8, ll. 6-14, the wedges 120" are shown having the retainers 124" integrated into the respective rear surfaces 162". The present invention generally comprises an implementation of the wall 102 including the deflectors 120 formed in connection with respective hollows in the wall 102, and having the retainers 124 fixed thereon or integrated into the respective rear surfaces 162. In particular, the present invention may advantageously implement the hollow (i.e., void, cavity, etc.) provided by the deflector 120 in the wall 102 to form at least one acoustic tuner that reduces or eliminates noise generated by the blast from the ejection port and mechanical noise generated by the firearm actuation during normal firing operation.

It may be desirable to implement a firearm spent casing catcher having walls that are made from material that is generally not eroded by the firearm ejection port blast while maintaining reduction of noise that is generated by the firearm ejection port blast and the firearm mechanism actuation. The apparatus 100 of the present invention may provide such a firearm spent casing catcher. Further, as the present invention comprises acoustic noise reduction via acoustic tuners, a broad range of noise frequencies (i.e., a wider acoustic spectrum) may be attenuated and a desirable amount of attenuation may be achieved.

The wedges (or deflectors) 120 are generally configured to deflect ejected cartridge casings 150 away from the opening 130 (i.e., away from the ejection port of the firearm and towards the lower box region of the housing 102 near the lid 102*b*) as the firearm where the catcher 100 is implemented (or installed) is discharged. The cartridge casings 150 are generally made from magnetically attracted material (e.g., mild steel, a combination of mild steel and brass (e.g., brass head and steel body, steel head and brass body, and the like). The retainers 124 generally magnetically attract and hold the ejected cartridge casings 150.

Referring to the FIGS. 2(A-C) of the present invention, diagrams illustrating cross sectional views of acoustic tuners 10, that may be implemented in connection with the present invention are shown. The principles of acoustics in general and acoustic tuners in particular are well known to one of ordinary skill in the art (e.g., the acoustic and sound wave property principles as generally taught in introductory college physics) and will only be described briefly herein to provide a context for the description of the acoustic tuner structures of the present invention.

Figure 2A:
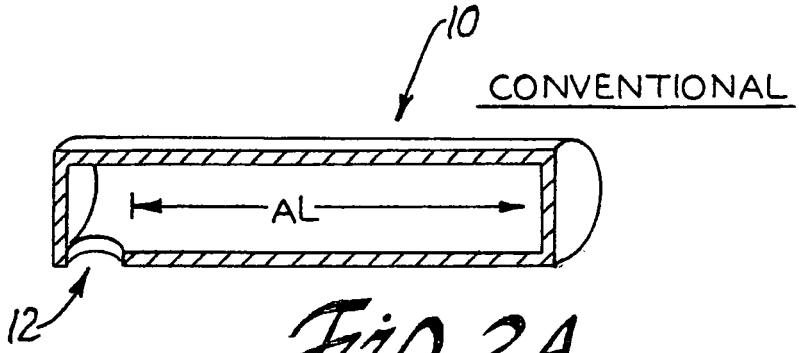
FIGS. 2(A-C) are diagrams of sectional views of acoustic tuners.

FIG. 2A illustrates a quarter wave tuner 10. The tuner structure 10 is a closed tube (shown as generally cylindrical, however, having any appropriate shape) that has an opening 12 where a sound wave impinges at one end, and an acoustic length, AL. When the impinging sound wave has a wavelength that is four times the acoustic length, AL, the sound wave will be canceled and the respective sound pressure level of the impinging sound wave (i.e., the amount of noise) will be attenuated.

Figure 2B:
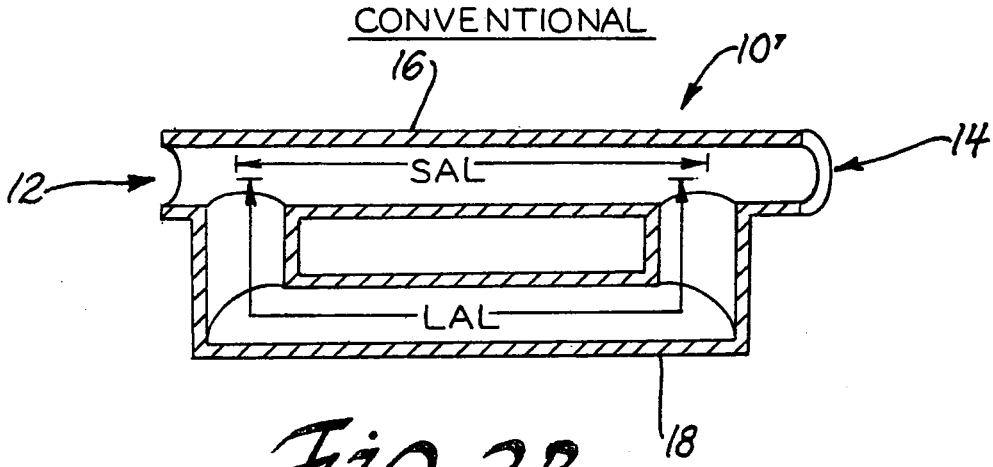

FIG. 2B illustrates a Herschel-Quincke (usually simply called Quincke) or interference tuner 10'. The Quincke tuner structure 10' includes a tube 16 and a tube 18 that are fluidly (i.e., acoustically) coupled at ends of the tube 18. The tube 16 has an opening 12 where a sound wave impinges, an outlet 14 where the impinging sound wave exits, and an acoustic length, SAL (e.g., a short acoustic length). The tube 18 has an acoustic length, LAL (e.g., a long acoustic length), that is greater than the acoustic length, SAL (i.e., LAL>SAL). When the impinging sound wave has a wavelength that is twice the difference of the acoustic length, LAL, minus the acoustic length, SAL, (i.e., LAL−SAL equals one half the wavelength of the impinging sound wave) the impinging sound wave will be canceled (i.e., the sound waves will interfere) and the respective sound pressure level of the exiting sound wave (i.e., the amount of noise from outlet 14) will be attenuated.

Figure 2C:
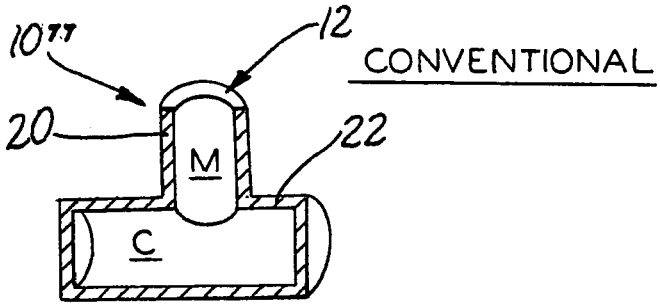

FIG. 2C illustrates a Helmholtz (or "jug") tuner 10". The tuner 10" generally comprises a tube 20 that has an opening 12 where a sound wave impinges at one end, and that is fluidly coupled to a closed cavity (shown as a cylinder, however, having any appropriate shape) 22. The volume of tube 20 is typically substantially smaller than the volume of the cavity 22. The interior of the tube 20 is filled with a gas having an acoustic mass, M, and the interior of the cavity 22 is filled with a gas having an acoustic compliance, C. The Helmholtz tuner structure 10" has a tuned frequency (i.e., a resonant frequency) that equals $2\pi$ times the square root of the acoustic mass, M, divided by the acoustic compliance, C (i.e., a "spring-mass" resonance frequency that equals $2\pi\sqrt{(M/C)}$). As such, a sound wave having the tuned frequency of the Helmholtz tuner 10" that impinges on the opening 12 is attenuated.

Figure 3:
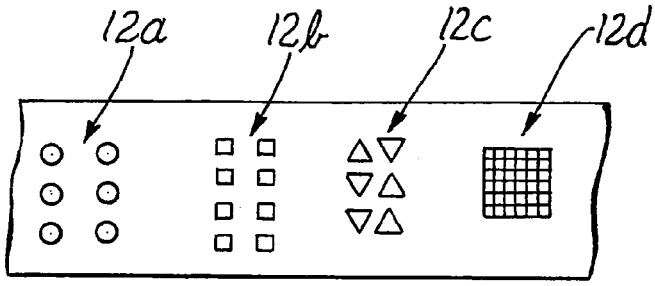
FIG. 3 is a diagram of some alternative example hole shapes of the present invention.

Referring to FIG. 3, a diagram illustrating some example alternative openings 12 is shown. While the opening 12 is shown as a simple hole in FIGS. 2(A-C), it is well known to one of ordinary skill in the art that more complex openings such as multiple round holes (e.g., holes 12*a*), holes having any appropriate shape (e.g., square openings 12*b* and triangular openings 12*c*), openings covered by a screen 12*d*, openings with relatively rough (i.e., not smooth, such that turbulence is induced, not shown) edges, and the like may be implemented in connection with the acoustic tuners 10, 10', and 10". Such alternative opening implementations may provide tuner openings that may be sized to prevent entry and entrapment of objects (e.g., spent firearm cartridge casings 150) in the tuners and may also provide acoustic resistance to the flow of the sound wave that impinges on the tuner opening 12. Such acoustic resistance generally provides tuning and hence noise reduction that is over a broader range of frequencies while at a reduced level when compared to a single, smooth hole opening.

Figure 4A:
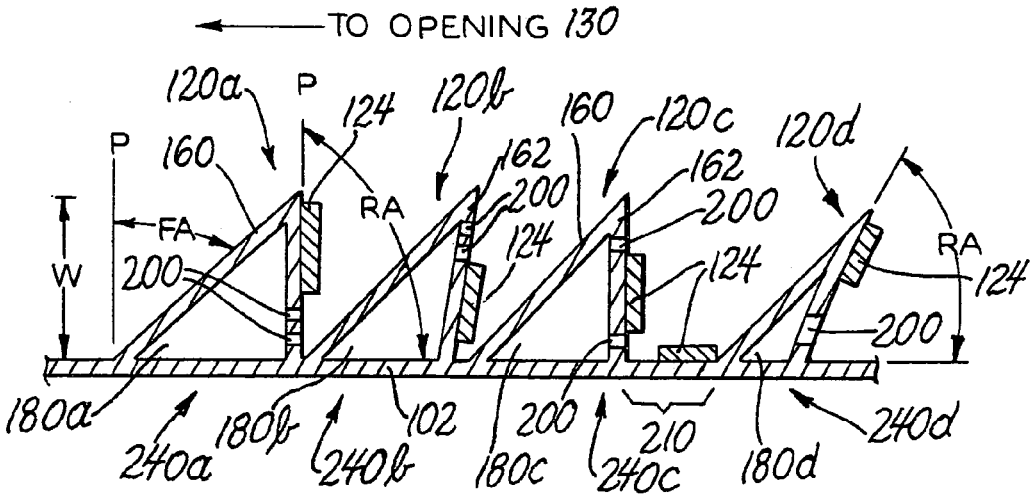
FIGS. 4(A-C) are diagrams of sectional views of some alternative example deflectors of the present invention.

Referring to FIGS. 4(A-C), diagrams illustrating sectional views taken at line 4 of FIG. 1 of example alternatives of the wedges 120 (e.g., wedges 120*a*-120*d*, 120*x*-120*z*, and the like) are shown. Each of the wedges 120 may have a face 160 that is oriented toward the opening 130 (also referred to as a front face, hereinafter) and a face 162 that is oriented away from the opening 130 (also referred to as a rear face, hereinafter). The front face 160 is generally slanted away from the opening 130 such that the casings 150 are deflected away from the opening 130 and generally toward the lid 102*b*.

The rear face 162 is generally perpendicular the planar surface of the housing 102 or slanted away from the opening 130 such that the casings 150 are resisted from traveling (moving, bouncing, flying, etc.) back toward the opening 130 even when bouncing inside the housing 102. Each of the deflectors 120 generally has the respective front face 160 that is slanted away from the opening 130, e.g., at an angle, FA, such that the deflectors 120 are capable of deflecting the casings 150 away from the opening 130 and the respective rear face 162 that is perpendicular to the planar surface of the housing or slanted away from the opening 130, e.g., at an angle, RA.

In one example, the deflectors 120 may be substantially adjacent (e.g., the deflectors 120*a* and 120*b*, and the deflectors 120*b* and 120*c*). In another example, (e.g., the deflectors 120*c* and 120*d*), the deflectors 120 may be separated by a gap 210.

The retainers 124 are generally implemented using a permanent magnet material (i.e., a material that is substantially permanently magnetic). The retainers may comprise at least one of steel, a Strontium and Barium ferrite, Samarium-Cobalt, Neodymium-Iron-Boron, other permanently magnetic rare earth alloys, and Alnico (i.e., Aluminum-Nickel-Cobalt alloy). However, the retainers 124 may be implemented using any appropriate permanently magnet material having a magnetic field strength sufficient to hold the expended magnetically attracted (e.g., steel) casings 150 to meet the design criteria of a particular application.

The present invention generally implements the retainers 124 having a maximum magnetic energy product value (i.e., level, amount, etc.) that is sufficient to capture and retain (catch and hold), for a particular application, expended shell casings 150 that are magnetically attracted. The deflectors 120 are generally capable of deflecting the cartridge casings 150 away from the opening 130, and the retainers 124 at the rear face of the deflectors 120 are generally capable of retaining the shell casings 150 when the catcher is in (i.e., oriented, held, placed, disposed, etc. in) any position and the firearm where the apparatus 100 is installed is operated in any position.

The retainers 124 may be substantially rectangular shaped. In one example, the retainers 124 may be shaped and sized such that one or more of the retainers 124 are fixed (i.e., fastened, adhered, affixed, mounted, etc.) to respective rear faces 162 (i.e., fixed to faces on the sides of deflectors 120 not facing the opening 130) and substantially cover the respective surface 162 (e.g., the respective retainers 124 that are implemented in connection with the deflectors 120*a*-120*d*). In another example, the retainers 124 may be shaped and sized to be mounted to the gap 210 between respective wedges 120 (e.g., the retainer 124 implemented in the space 210 between the wedge 120*c* and the wedge 120*d*). In yet another example (see, for example, FIG. 4C), the retainers 124 may be embedded into (or integrated within) the wall 102.

The wedge 120 may have a height, W, that is generally equal to or greater than the diameter of the cartridge casing 150 that is captured (or caught) by the catcher 100. However, the height W may be implemented as any appropriate value (i.e., amount, distance, etc.) to meet the design criteria of a particular application.

The front face 160 is generally at an angle (e.g., FA) relative to a line or plane (e.g., P) that is perpendicular to the surface of the housing 102. The angle FA is generally in a range of 30 degrees to 75 degrees and preferably in a range of 45 degrees to 60 degrees. The rear face 162 is generally at an angle (e.g., RA) relative to line or plane P. The angle RA is generally in a range of 0 degrees to 35 degrees and preferably in a range of 0 degrees to 25 degrees. The angle RA is generally less than the angle FA. However, the angles FA and RA may be implemented at any appropriate angles to meet the design criteria of a particular application.

A void (i.e., cavity, chamber, etc.) 180 (e.g., voids 180*a*-180*d*) is generally formed between the respective faces 160 and 162 of the deflectors 120 and the respective wall 102. Further, at least one opening (i.e., hole, aperture, etc.) 200 may be implemented to provide fluid communication between the inside of the casing catcher 100 and the void 180. The configuration of the void 180 and the opening 200 is generally implemented as an acoustic tuner structure 240 (e.g., tuners 240*a*-240*d*) such as a quarter wave tuner, a Quincke tuner, and a Helmholtz resonator similar to the acoustic tuners illustrated in FIGS. 2(A-C), respectively. The acoustic tuner structure 240 of the present invention is generally tuned to provide reduction of noise emitted at the firearm ejection port and mechanical noise generated by the operation of the firearm mechanism. Support for the lower front edge of the wedges 120 may be provided by one or more supports 220 that are generally disposed from the lower front edge of the respective deflector 120 and the wall 102.

The holes 200 may be implemented similar to the holes 12 of FIGS. 2(A-C). The apertures 200 may be implemented having a size small enough such that the cartridge casings 150 are not able to enter the void 180 for the design criteria of a particular application. The opening 200 may be implemented having any appropriate shape (e.g., shapes such as round, square, triangular or as screen as shown in FIG. 3) to meet the design criteria of a particular application.

To provide sufficient volume for the void 180 or to provide an acoustic path or acoustic tuning length, two or more of the deflectors 120 may be separated from the wall 102 via a gap (e.g., G). The gap G generally provides fluid communication such that an adequate acoustic length, mass, or compliance is formed for the respective acoustic tuner structure.

Figure 5A:
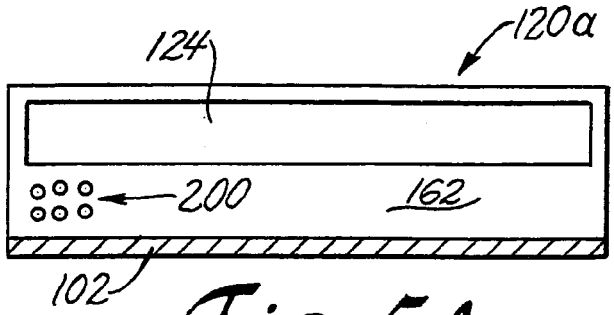
FIGS. 5(A-C) are diagrams of views of the rear face of some alternative examples of the deflectors of FIGURES (A-C)
Figure 5B:
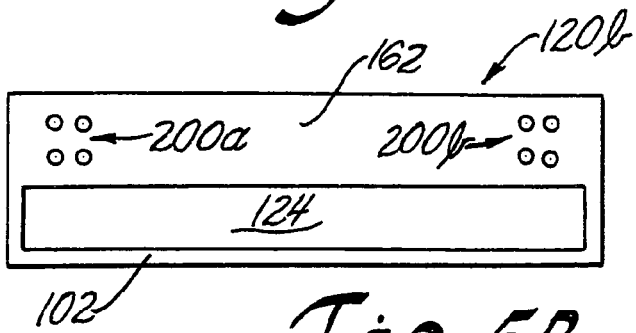
Figure 5C:
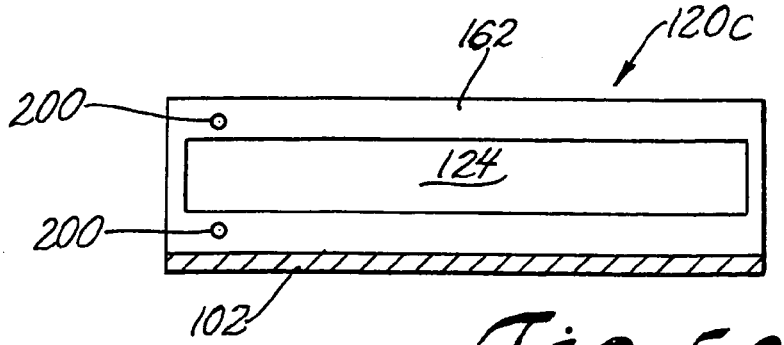

Referring to FIGS. 5(A-C), diagrams illustrating views of the rear faces 162 of the wedges 120*a*, 120*b*, and 120*c*, respectively are shown. The FIGS. 5(A-C) illustrate example placement of the holes 200. The placement of the holes 200 in FIGS. 5A and 5C may be advantageously implemented in connection with quarter wave tuner and Helmholtz resonator acoustic tuner structures (i.e., various implementations of the tuner 240). The placement of the holes 200*a* and 200*b* in FIG. 5B may be advantageously implemented in connection with a Quincke tuner acoustic tuning structure.

Figure 4B:
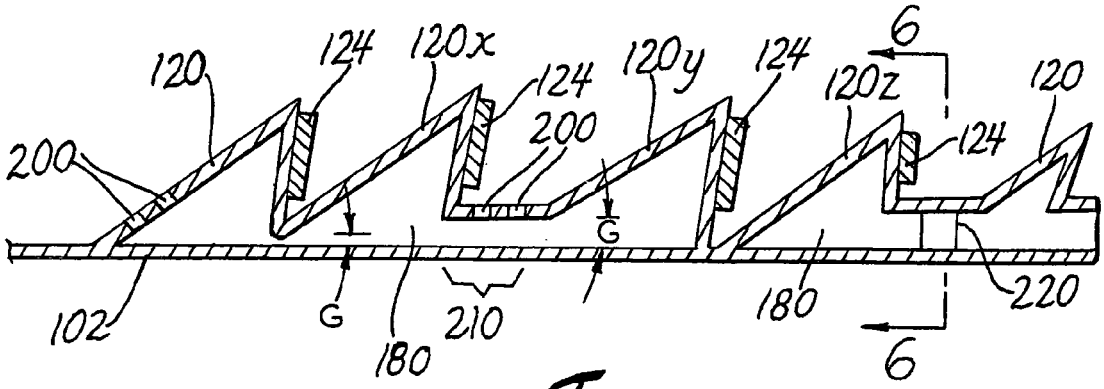
Figure 4C:
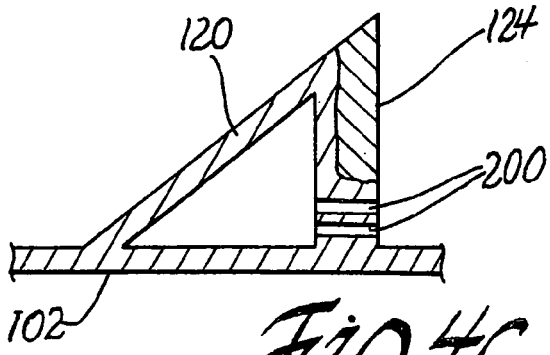

Referring to FIG. 6, a diagram illustrating a sectional view taken at the line 6-6 of FIG. 4B is shown. The legs 220 may provide physical support such that the housing 102 may be physically robust for severe operating conditions as may be encountered during military usage. The passages 200 (i.e., channels, ports, openings, holes, apertures, etc.) resulting from the implementation of the legs 220 may be implemented, in one example, as openings for respective acoustic tuning structures, and, in another example, to provide fluid communication such that sufficient acoustic volume and length for tuning path, tuning length, or tuning compliance is formed.

Referring to FIG. 7, a diagram illustrating a top view of portion of FIG. 4B is shown. In particular, the openings 200 implemented in the gap 210 between the deflectors 120*x* and 120*y* are shown.

Figure 8A:
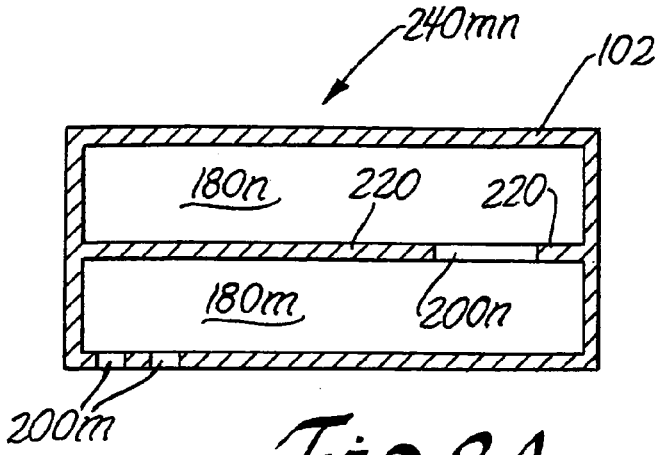
FIGS. 8(A-C) are diagrams of sectional top views of some alternative acoustic tuner structures of the present invention.

Referring to FIG. 8A, a diagram illustrating a top sectional view of one example of an acoustic tuner 240*mn* of the present invention is shown. In one example, the acoustic tuner 240*mn* may be implemented as a quarter wave tuner having an opening 200*m*, and an overall acoustic quarter wave tuning length provided by the length of the void 180*m* plus the length of the void 180*n* as acoustically coupled via the hole 200*n*. While only two of the voids 180 are illustrated as serially coupled to provide an acoustic length, as many of the voids 180 may be fluidly coupled to provide an appropriate acoustic length to meet the design criteria of a particular application.

Figure 8B:
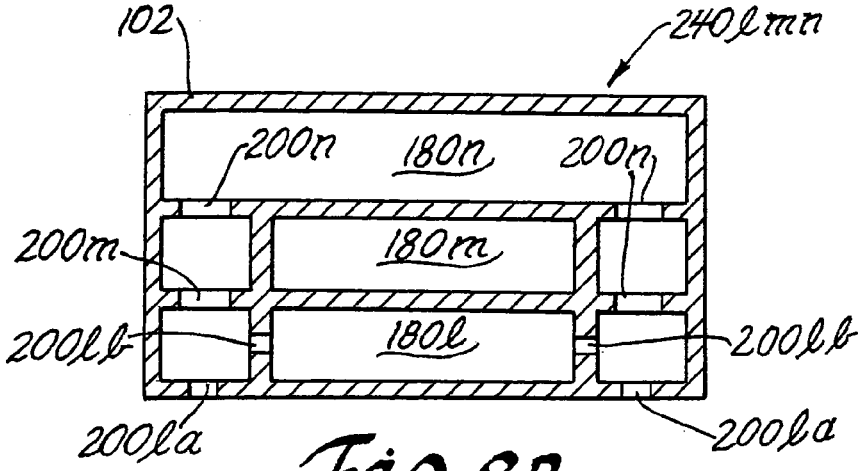

Referring to FIG. 8B, a diagram illustrating a top sectional view of one example of an acoustic tuner 240*lmn* of the present invention is shown. In one example, the acoustic tuner 240*lmn* may be implemented as a Quincke tuner. The void 180*l* may be implemented as having the short tuning length (e.g., the acoustic length between the holes 200*lb*. The void 180*m* may be acoustically isolated and, thus, may not form a part of the tuner structure 240*lmm*. The acoustic length of the path between the holes 200*la* (including the length of the void 180*n*) may be implemented as the long acoustic tuning length of the Quincke tuner 240*lmn*.

Figure 8C:
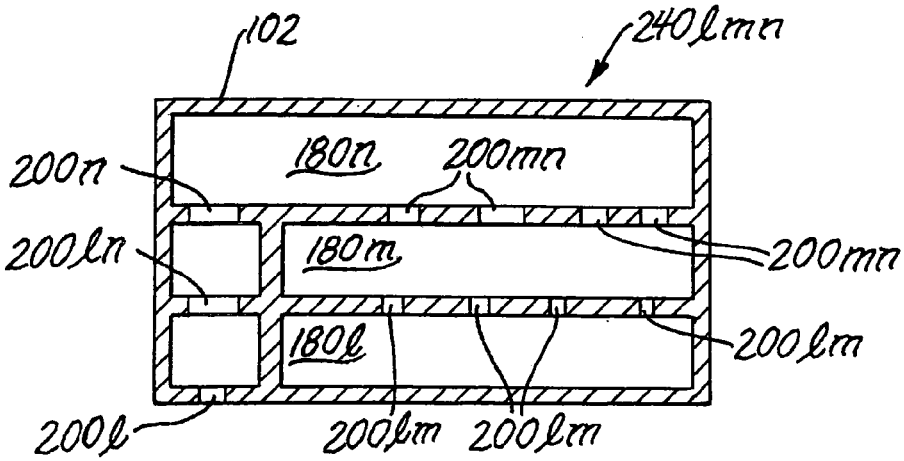

Referring to FIG. 8C, a diagram illustrating a top sectional view of another example of an acoustic tuner 240*lmn* of the present invention is shown. In one example, the acoustic tuner 240*lmn* may be implemented as a Helmholtz resonator tuner acoustic structure. The acoustic path implemented via the opening 200*l*, the opening 200*ln*, and the opening 200*n* may be implemented as an acoustic mass. The combination of the voids 180*l*, 180*m*, and 180*n* as implemented via the openings 200*lm* and 200*mn* may be implemented as the respective acoustic compliance of the Helmholtz tuner 240*lmn* of the present invention.

Referring back generally to FIG. 1, the seal (or gasket) 106 generally comprises a resilient, compliant material (e.g., vinyl, butyl, neoprene, etc. in a solid, gel-sac, closed-cell foam, skin covered foam, or other appropriate configuration). The seal 106 is generally fastened to the edge of the housing 102 and liner 104 that abut the ejection port region of the firearm. While the housing 102 and the seal 106 are shown having a flat surface 110 that contacts the firearm where the present invention is implemented, the housing 102 at the opening 130 and the seal 106 are generally shaped to substantially match an interfacing surface of the firearm where the catcher 100 is implemented as shown below in connection with FIGS. 9-12.

The seal 106 may be attached to the housing 102 at the opening 130 and may completely surround the opening 130. The seal 106 generally comprises a resilient, compliant material in a solid, gel-sac, closed-cell foam, or skin covered foam configuration having the surface 110 that interfaces to the firearm. The surface 110 includes at least three resilient, compliant sealing lips (e.g., ribs, ridges, etc.) 250 that provide controlled release of gas pressure generated inside the housing 102 as the firearm is discharged such that blast noise, flash, flame, report, etc. from the escape of the pressurized ejection port gas is reduced or eliminated (i.e., damped, diminished, etc.). The ribs 250 may be separated by gaps (i.e., spacings, separations, distances, etc.) 260. As there are generally at least three lips 250, there are generally at least two inter-lip gaps 260. While the lips 250 are shown in FIG. 1 as substantially half-round shaped ribs (see also, for example FIGS. 10 and 12A), the lips 250 may be implemented having any appropriate shape to meet the design criteria of a particular application.

When the catcher 100 is mounted to the firearm, the seal 106 generally provides a substantial barrier to noise and flash (e.g., a substantially air-tight or hermetic seal that may be progressively flexed by escaping pressurized ejection port gas) that is generated during the ejection of a spent cartridge. The seal 106 may also provide mechanical damping to vibration of the firearm where the catcher 100 is implemented such that noise generated by the firearm action operation as well as the discharge noise at the ejection port may be reduced or eliminated. The seal 106 may be configured to provide a substantially air-tight path between the ejection port and the opening 130 when the gas pressure inside the housing 102 is at substantially atmospheric pressure.

Figure 9:
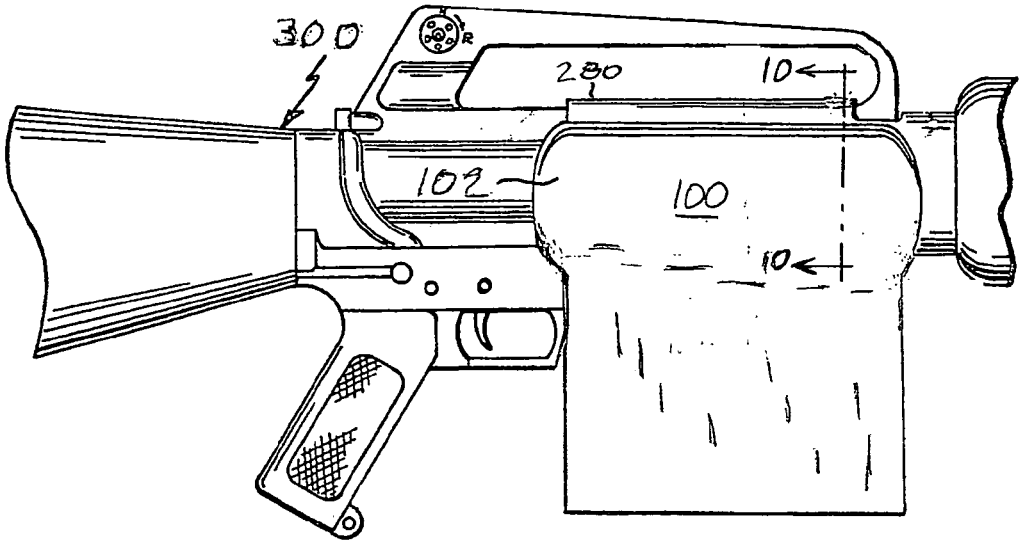
FIG. 9 is a right side elevation of a portion of a firearm having the casing catcher of FIG. 1 installed thereon.

Referring to FIG. 9, a diagram illustrating a right side elevation of a relevant portion (e.g., receiver portion with buttstock and forearm/barrel portions shown as truncated) of a firearm 300 having installed thereon (e.g., mounted thereto, fastened upon, etc.) an example of the cartridge casing apparatus 100 of the present invention is shown. While the firearm 300 is illustrated as an M4 carbine/M16 rifle, the system 100 of the present invention may be installed on any appropriate firearm. A bracket (i.e., mount, clamp, clip, coupler, hanger, attachment, etc.) 280 is generally implemented in connection with the housing 102 to fasten (i.e., affix, hook, clamp, couple, etc.) the cartridge casing 100 to the firearm 300.

Figure 10:
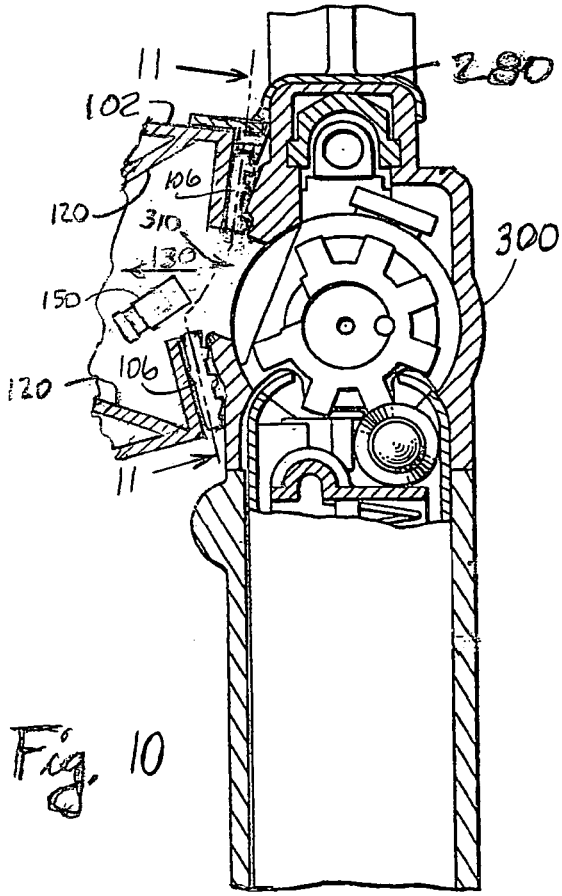
FIG. 10 is rearward facing sectional view of a portion of the firearm and casing catcher of FIG. 9.

Referring to FIG. 10, a rearward facing sectional view taken at line 10-10 of FIG. 9 is shown. Internal components of the firearm 300, a magazine housing, ammunition, and the like are illustrated for reference. The cartridge casing catcher 100 is shown, in part, as attached to the firearm 300 at an ejection port 310. The opening 130 is in mechanical and fluid communication with the ejection port 310. Gas that is generated as the firearm 300 is discharged is generally fluidly communicated into the housing 102. The casings 150 are generally mechanically ejected into the housing 102 via the opening 130. The bracket 280 mounts the cartridge casing catcher 100 to the firearm 300. The seal 106 interfaces the catcher housing 102 to contours of the firearm 300 at the ejection port 310.

Figure 11:
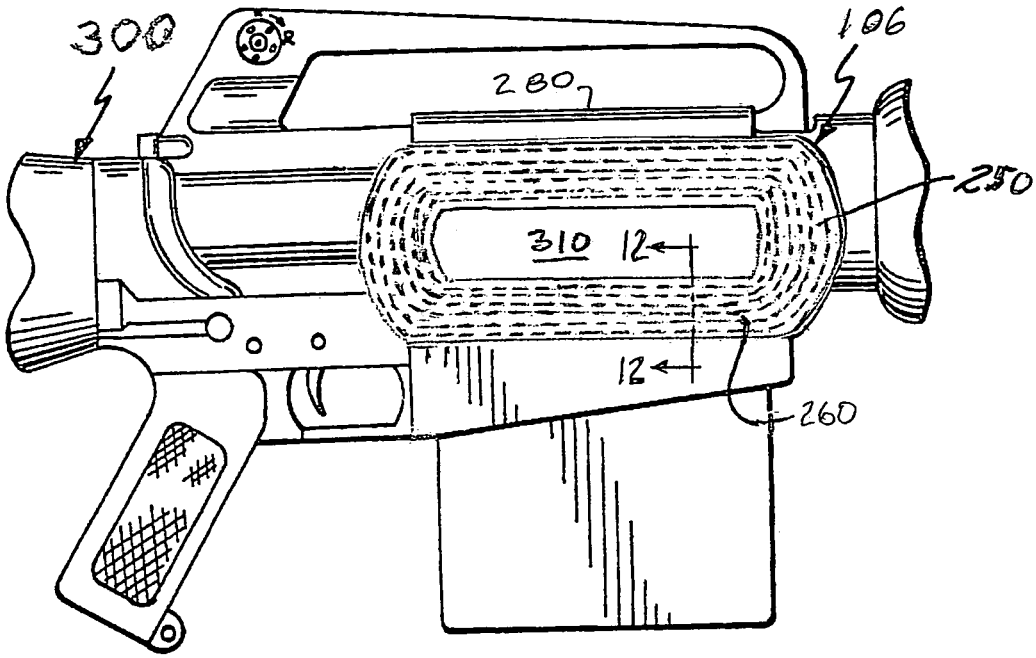
FIG. 11 is a leftward facing sectional view of the firearm and cartridge casing catcher of FIG. 10.

Referring to FIG. 11, a right facing sectional view taken at line 11-11 of FIG. 10 is shown. FIG. 11 generally illustrates the interface of the seal 106 at the ejection port 310. The seal 106 generally surrounds the ejection port 310. The sealing lips 250 (shown via hidden lines) may interface to the firearm 300.

Referring collectively to FIGS. 12 (A-F), rearward facing sectional views of example alternative implementations of the seal 106 taken at line 12-12 of FIG. 11 are shown. The examples of the seal 106 shown in FIGS. 12(A-F) are illustrative, and the seal 106 may be implemented having any appropriate configuration to meet the design criteria of a particular application. The at least three resilient, compliant sealing lips 250, in connection with the body of the seal 106, are generally sized and shaped to provide controlled release of ejection port gas pressure generated and fluidly transmitted to inside the housing 102 as the firearm is discharged.

When the catcher 100 is mounted to the firearm 300, the lips 250 may be compressed into the body of the seal 106 as well as bent over. The pressurized gas generally displaces (e.g., flexes, bends, moves, etc.) the sealing ridges 250. The escape of the pressurized ejection port gas may be envisioned as generating a ripple effect outwardly from the ejection port 310 such that at least a portion of the seal 106 remains in contact with the firearm 300 at all times.

The ribs 250 may have a height, H, and a width, W. In one example (e.g., as shown in FIGS. 12(A-C) and 12F), the ribs 250 may have substantially equal heights, H, and substantially equal widths, W. The body of the seal 106 may have a thickness, T. In one example, the thickness, T, of the body of the seal 106 may be greater than the height, H, of the lips 250 (see, for example, FIGS. 12(A-C). However, the lips 250 may be implemented having a greater height, H, than the seal body thickness, T (see, for example, FIG. 12D where lip 250L has a respective height, Hl, that is greater than the thickness, T.

Figure 12A:
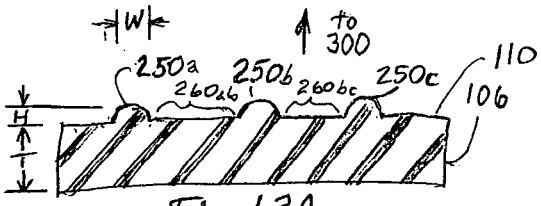
FIGS. 12 (A-F) are rearward facing cross-sectional views of alternative examples of a housing to firearm seal of the casing catcher of FIG. 11.

The at least three ribs (e.g., in FIG. 12A, ribs 250*a*, 250*b*, and 250*c*) may be separated by the two respective inter-rib spacings 260 (e.g., also in FIG. 12A, a spacing 260*ab* between the ribs 250*a* and 250*b*, and a spacing 260*bc* between the ribs 250*b* and 250*c*). In one example, the inter-sealing lip gaps 260 may be substantially equal. The sealing lips 250 are generally spaced apart via the gaps 260 such that the distance between adjacent sealing lips is greater than the height, H, of the lips 250.

The energy required to displace the lips 250 generally causes reduction of the gas pressure such that noise from the ejection port blast is reduced or eliminated. Impingement of the escaping firearm discharge gas through the seal 106 into the atmosphere (i.e., past the at least three lips 250 and over the at least two inter-lip gaps 260) generally cools and absorbs particles in the burning gas such that flash (or flame) and the respective noise from the ejection port blast is reduced or eliminated. While the lips 250 are shown in FIGS. 12(A-F) as substantially half-round shaped ribs (see, for example FIG. 12A) and substantially triangular cross-sectional shape (see, for example, FIGS. 12(B-F)), the lips 250 may be implemented having any appropriate shape to meet the design criteria of a particular application.

Referring in particular to FIG. 12A, the ribs 250 (e.g., ribs 250*a*, 250*b*, and 250*c*) may be formed on the surface 110 that interfaces to the firearm 300 in a substantially semi-round (i.e., half-round, hemispherical, etc.) cross-sectional shape having a flat side of the semi-round shape integral with the surface 110. As the cross-sectional shape of the ribs 250*a*, 250*b*, and 250*c* may be substantially semi-round, the respective height, H, and the width, W, may be substantially equal. In one example, inter-sealing lip gaps 260*ab* and 260*bc* may be substantially equal. The sealing lips 250 are generally spaced apart via the gaps 260*ab* and 260*bc* such that the distance between adjacent sealing lips is greater than the height H, of the half-round shape.

Figure 12D:
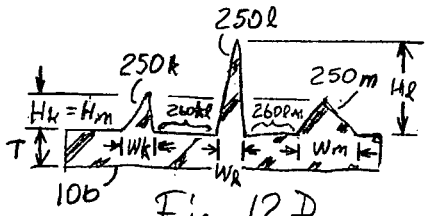
Figure 12B:
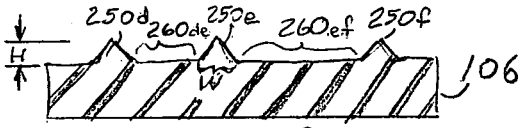

Referring in particular to FIG. 12B, in another example the sealing lips 250 (e.g., lips 250*d*, 250*e* and 250*f*) may be formed on the surface 110 that interfaces to the firearm 300 in a substantially triangular cross-sectional shape having one side of the triangular shape integral with the surface 110. The triangular cross-sectional shape may be substantially equilateral. The lips 250*d*, 250*e* and 250*f* may have substantially equal height, H, and substantially equal width, W.

The sealing lips 250*d*, 250*e* and 250*f* are generally spaced apart such that the distance 260 between adjacent sealing lips (i.e., the respective distances 260*de* between the ribs 250*d* and 250*e*, and distance 260*ef* between the ribs 250*e* and 250*f*) is greater than the height, H, of the triangular shape (and hence, the width, W). The gaps between adjacent sealing lips (e.g., the gap 260*de* and the gap 260*ef*) may be unequal. For example, the gap 260*de* may be smaller than the gap 260*ef*.

Figure 12E:
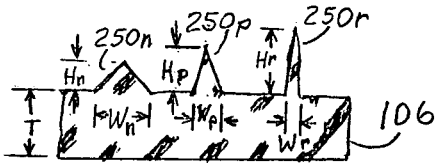
Figure 12C:
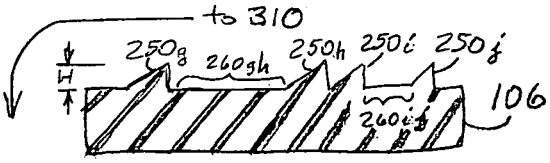

Referring in particular to FIG. 12C, in another example the sealing lips 250 (e.g., lips 250*g*, 250*h*, 250*i*, and 250*j*) may be formed on the surface 110 that interfaces to the firearm 300 in a substantially triangular cross-sectional shape having one side of the triangular shape integral with the surface 110. The triangular cross-sectional shape may be scalene (i.e., having three unequal length sides).

The gaps 260 between adjacent sealing lips 250 (e.g., gap 260*gh* and gap 260*ij*) may be unequal. For example, the gap 260*ij* may be smaller than the gap 260*gh*. The lips 250*h* and 250*i* may be substantially adjacent such that there is no gap 260*hi*.

The apex of the triangular shaped sealing lips may be biased outwardly from the opening 130 and the ejection port 310.

Referring in particular to FIG. 12D, in another example the sealing lips 250 (e.g., lips 250*k*, 250*l*, and 250*m*) may be formed on the surface 110 that interfaces to the firearm 300 in a substantially triangular cross-sectional shape having different respective heights, H. For example, the ribs 250*k* and 250*m* may be implemented having a height, Hk=Hm, and the rib 250*l* may be implemented having a height, Hl, that is greater than the height, Hk. The height, Hk, may be substantially equal to or less than the thickness, T, and the height, Hl, may be greater than the thickness, T.

Respective inter-rib spacings 250 (e.g., spacings 250*kl* and 250*lm*) may be essentially equal. The height, Hl, may be greater than the length of the spacings 250*kl* and 250*lm*. As such, the lip 250*l* may overlap the rib 250*k* or the rib 250*m* when the catcher 100 is installed on the firearm 300.

The lips 250*k* an 250*l* may have the substantially equal respective widths. For example, the lip 250*k* may have a width, Wk, the lip 250*l* may have a width, Wl, and the width Wk may be essentially equal to the width Wl. However, the lip 250*m* may have a width, Wm, that is substantially wider than the widths Wk and Wl.

Referring in particular to FIG. 12E, in another example the sealing lips 250 (e.g., lips 250*n*, 250*p*, and 250*r*) may be formed on the surface 110 that interfaces to the firearm 300 in a substantially triangular cross-sectional shape having different respective heights, H, and widths, W. For example, the rib 250*n* may be implemented having a height, Hn, and a width, Wn. The rib 250*o* may be implemented having a height, Hp, and a width, Wp. The rib 250*r* may be implemented having a height, Hr, and a width, Wr.

The height, Hp may be greater than the height, Hn, and the height, Hr, may be greater than the height, Hp, and substantially equal to the thickness, T. The width, Wn, may be wider than the width, Wp, and the width, Wp, may be wider than the width, Wr.

Figure 12F:
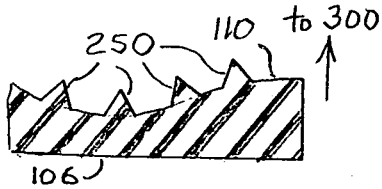

Referring in particular to FIG. 12F, the surface 110 may be implemented having a curved shape that is contoured to snugly match (i.e., mate, fit, etc.) the respective firearm 300 to which the apparatus 100 is installed.

As is apparent then from the above detailed description, the present invention may provide an improved multi-position cartridge casing catcher. Such an improved cartridge casing catcher may provide reduced or eliminated noise and flash from a firearm ejection port and so reduce or eliminate jamming caused by the spent cartridges bouncing back, reduced or eliminated rattle of collected shell casings, and reduced or eliminated bouncing of the spent cartridges back into the firearm ejection port as the firearm is operated in any position when compared to conventional approaches.

Various alterations and modifications will become apparent to those skilled in the art without departing from the scope and spirit of this invention and it is understood this invention is limited only by the following claims.

What is claimed is:

1. A catcher, in combination with a firearm having an ejection port, for receiving and retaining expended magnetically attracted shell casings through the ejection port as the firearm is discharged, the catcher comprising:

a hollow housing having a plurality of rigid walls, wherein one of the walls has an opening in communication with the ejection port when the catcher is mounted to the firearm for receiving the shell casings, at least one of the other walls comprises a plurality of deflectors and each of the deflectors has a front face that is slanted away from the opening such that the deflectors are capable of deflecting the shell casings away from the opening and a rear face that is perpendicular to the planar surface of the housing or slanted away from the opening, and at least one of the deflectors, alone or in combination with one or more other of the deflectors and a respective wall, comprise a void and an aperture configured as an acoustic tuner structure tuned to provide reduction of noise emitted at the ejection port;

a seal attached to the housing at the opening and surrounding the opening, wherein the seal comprises a resilient, compliant material in a solid, gel-sac, closed-cell foam, or skin covered foam configuration having a surface that interfaces to the firearm and the surface includes at least three resilient, compliant sealing lips that provide controlled release of pressurized ejection port gas from inside the housing as the firearm is discharged such that noise and flash as a result of escape of the pressurized ejection port gas is reduced or eliminated; and retainers at the rear face of the deflectors capable of retaining the shell casings when the catcher is in any position, wherein the retainers comprise a permanent magnetic material.

2. The catcher of claim 1 wherein the retainers have a maximum magnetic energy product value that is sufficient to capture and retain the expended shell casings.

3. The catcher of claim 1 wherein the acoustic tuner structure comprises at least one of a quarter wave tuner, a Quincke tuner, and a Helmholtz tuner.

4. The catcher of claim 1 wherein the magnetic material comprises magnetic strips that are affixed to the rear face of respective deflectors.

5. The catcher of claim 1 wherein each of the deflectors has a height that is equal to or greater than the diameter of the shell casings that are captured by the catcher.

6. The catcher of claim 1 wherein the deflectors are adjacent or separated by a gap.

7. The catcher of claim 6 wherein the magnetic material further comprises magnetic strips that are affixed to the gaps when the deflectors are separated by the gap.

8. The catcher of claim 1 wherein the magnetic material is embedded into the rear face of respective deflectors.

9. The catcher of claim 1 wherein the magnetic material is at least one of steel, Strontium and Barium ferrite, Samarium-Cobalt, Neodymium-Iron-Boron, and Aluminum-Nickel-Cobalt alloy.

10. The catcher of claim 1 wherein the sealing lips are formed on the surface that interfaces to the firearm in a substantially triangular shape having one side of the triangular shape integral with the surface.

11. The catcher of claim 10 wherein the sealing lips are spaced apart such that the distance between adjacent sealing lips is greater than the height of the triangular shape.

12. The catcher of claim 10 wherein the apex of the triangular shaped sealing lips is biased outwardly from the opening.

13. The catcher of claim 1 wherein the sealing lips are formed on the surface that interfaces to the firearm in a substantially half-round shape having the flat base of the half-round shape integral with the surface.

14. The catcher of claim 13 wherein the sealing lips are spaced apart such that the distance between adjacent sealing lips is greater than the height of the half-round shape.

* * * * *